US005779552A

United States Patent [19]

Gelfond et al.

[11] Patent Number: 5,779,552

[45] Date of Patent: Jul. 14, 1998

[54] ILLUSORY LIQUID APPARATUS

[75] Inventors: Lisa Gelfond; Sandra A. Levin, both of Chicago; Randall Jon Klimpert, Wilmette; Horst Dieter Herbstler, Bolingbrook, all of Ill.

[73] Assignee: Meyer/Glass Design, Ltd., Chicago, Ill.

[21] Appl. No.: 712,398

[22] Filed: Sep. 13, 1996

[51] Int. Cl.[6] ..... A63G 31/00

[52] U.S. Cl. ..... 472/67; 472/71

[58] Field of Search ..... 472/67, 71, 57, 472/128; 446/154, 161

[56] References Cited

U.S. PATENT DOCUMENTS

| | | | |
|---|---|---|---|
| 2,525,232 | 10/1950 | McGaughy | 472/67 |
| 2,648,157 | 8/1953 | Wilson et al. | 472/67 X |
| 3,924,350 | 12/1975 | Hau | 472/67 X |
| 4,159,594 | 7/1979 | Reiner et al. | 446/239 |
| 4,662,627 | 5/1987 | Utley | 472/67 |
| 5,118,321 | 6/1992 | Greenberg et al. | 446/304 |

*Primary Examiner*—Kien T. Nguyen
*Attorney, Agent, or Firm*—Marc J. Whipple

[57] ABSTRACT

An illusory liquid apparatus is disclosed which provides the illusion of an item appearing and disappearing. An illusory item is suspended in a translucent or opaque fluid, and raised and lowered to alternatively be visible at the top of the fluid, and hidden under the surface of the fluid. Also disclosed is a new means for moving the illusory item by means of magnetic attraction. A magnetic attractor is placed in the illusory item, and magnetic attraction is used to raise and lower the illusory item. Alternatively, liquid may be moved to alternatively cover a fixed illusory item and then reveal it, or a mechanical linkage used to raise and lower the illusory item in the liquid. A new configuration for an illusory liquid apparatus is also disclosed in which the completely sealed outer body and inner vessel of the illusory liquid apparatus avoids the use of complex mechanical linkages.

8 Claims, 3 Drawing Sheets

ILLUSORY LIQUID APPARATUS

BACKGROUND OF THE INVENTION

While the present invention is suitable for a wide range of uses, it is described here in relation to food related toy items. Food related toys are an old and well-known part of the toy world, with illusory food related toys going back at least several decades to the well-known "disappearing milk bottle." Many dolls and doll related toys (most notably BABY ALL GONE by Kenner and variants thereof, see U.S. Pat. No. 5,118,321, etc.) include some means for the appearance that food is being eaten by a doll during nurturing play. Many of these items suffer from overcomplexity, making them expensive to produce and subject to wearing out and malfunctioning after a short period of use. In addition, some of these devices require more or less elaborate preparation and activation, diminishing the play value by breaking the illusion that the child is feeding food to a doll. This may also require special components that will only work as a set: for instance, U.S. Pat. No. 4,159,194 describes a spoon which provides the illusion of food being eaten, but both the doll used and a container accompanying the apparatus must have properly aligned magnets for the spoon to operate.

Finally, if the toy is to be used by young children, the complexity and fragility of many food related toys is an inconvenience at best and a danger at worst. Children are haphazard in their use of and care for toys: the requirements for care and gentle treatment in the use of many food related action toys are too much to expect of the average child. If the toy is broken, not only is its play value lost, but small and sharp pieces may be exposed, endangering the child, while any fluids contained may escape, possibly damaging surrounding objects or injuring the child. The present invention addresses all of these use and safety concerns.

OBJECTS OF THE INVENTION

An object of the invention is to provide an illusory liquid apparatus which gives the illusion of the appearance and disappearance of objects in a liquid.

A second object of the invention is to provide an illusory liquid apparatus that is safe for young children, as any fluids present may be contained in a sealed unit.

A third object of the invention is to provide an illusory liquid apparatus that is simple and durable due to its lack of mechanical linkages and other complex parts.

A fourth object of the invention is to provide an illusory liquid apparatus that is independent of special accessories or prepared objects.

Other objects and advantages of the invention will become apparent in the following disclosure.

SUMMARY OF THE INVENTION

The present invention relates to a an illusory liquid apparatus, specifically to a new mechanism for providing the illusion of appearance and disappearance of an item in a liquid. This is done by suspending an illusory unit in a translucent or opaque fluid, and raising it and lowering it. A novel way of doing this, described herein, is by means of magnetic attraction. By means of a magnetic attractor placed on the illusory unit, and a second variable magnetic attractor elsewhere in the apparatus, the illusory item may be raised and lowered without direct physical contact. The present invention also provides a new configuration for the illusory liquid apparatus, allowing a simpler, more durable, and safer construction than previous items. This is made possible by the complete sealing of the outer body and the inner vessel, avoiding the use of complex mechanical linkages and preventing the escape of small parts or internal fluids.

An alternative method is also described wherein a transparent or opaque fluid is moved in and out of a chamber containing a fixed illusory unit, alternatively revealing and obscuring the illusory item. A second alternative method is further described where a traditional mechanical linkage replaces the magnetic attractors. These alternative methods present a more traditional and less expensive means of practicing the invention.

BRIEF DESCRIPTION OF THE DRAWINGS

The characteristic features of the invention will be particularly pointed out in the claims. The descriptions of the preferred embodiment refer to the preceding drawings:

FIG. **6*a*** is a perspective view of the food unit and transparent cover assembly in the mechanical linkage alternate embodiment.

Figure 7:
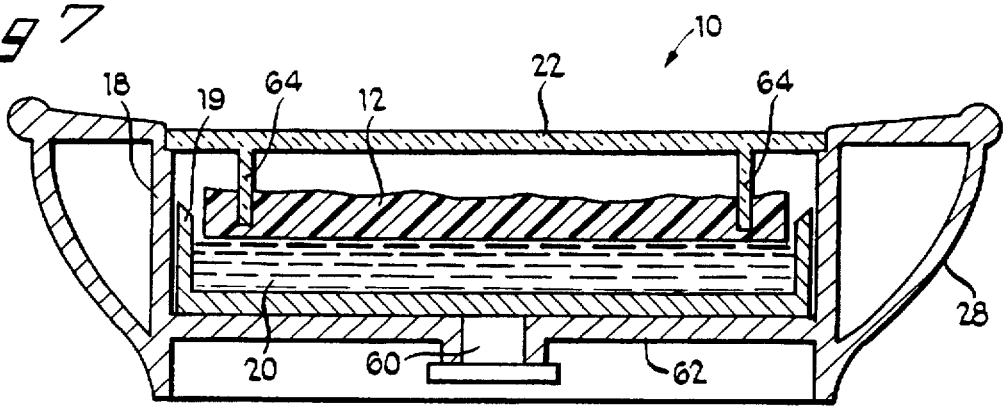

FIG. 7 is a cross-sectional side view of an alternate embodiment using a mechanical linkage with the food unit visible.

Figure 8:
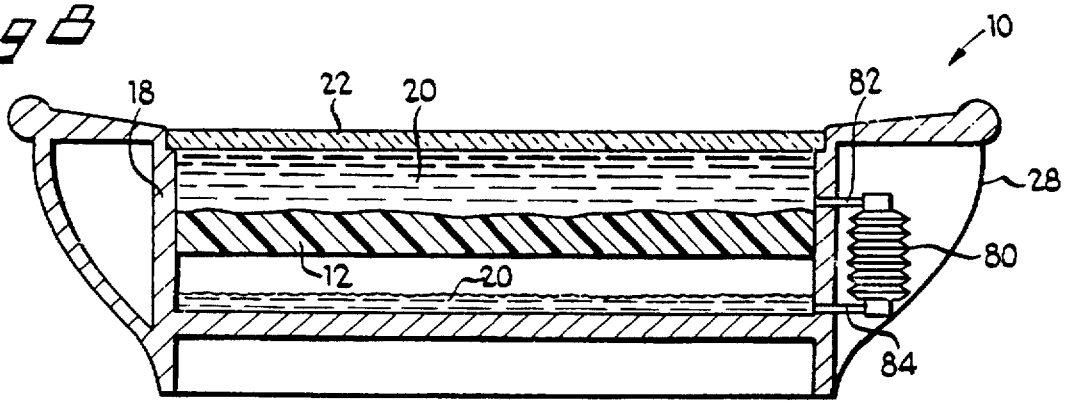

FIG. 8 is a cross-sectional side view of an alternate embodiment using a pump system with the food unit hidden.

Figure 9:
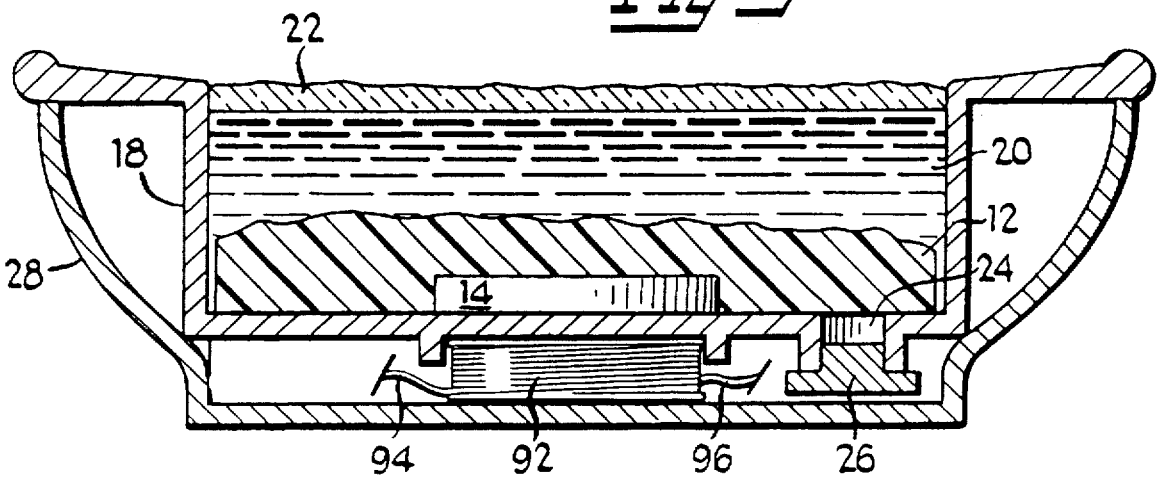

FIG. 9 is a cross-sectional side view of an alternate embodiment using an electromagnet with the food unit hidden.

DESCRIPTION OF THE PREFERRED EMBODIMENT

The description of the preferred embodiment uses the invention in a bowl which alternately appears to contain food, and then not to contain food, providing the illusion that the food has been consumed and replenished. When describing the preferred embodiment, the tern "food item" is used. When describing the invention in general, the term "illusory item" is used. These terms are equivalent for purposes of this application, although the broadest possible meaning should always be understood. The invention is suitable for a wide range of illusory toy uses. Although the primary and preferred embodiment, described first uses a non-contact system (magnetic attraction) to raise and lower the illusory item, this is not required, and two alternate embodiments are also described using more traditional mechanical and hydraulic systems.

Figure 1:
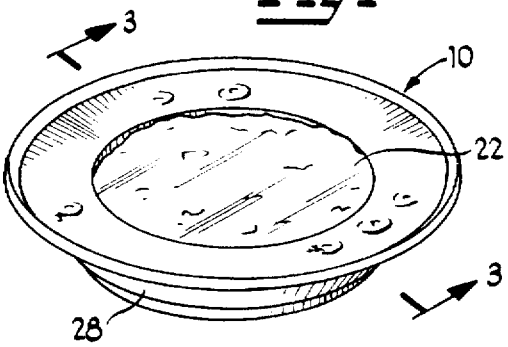
FIG. 1 is a representational view of the entire apparatus with the food item hidden.
Figure 2:
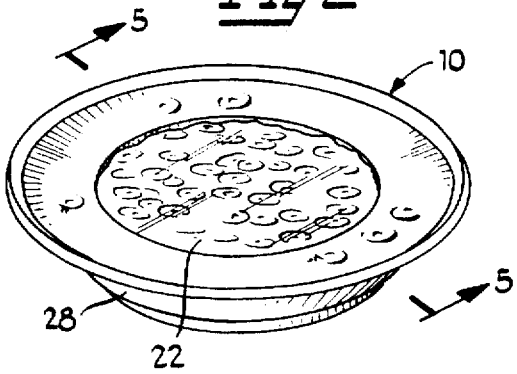
FIG. 2 is a representational view of the entire apparatus with the food item visible.

By referring to FIG. 1 and FIG. 2, the basic concept of the invention may be easily understood. The invention constitutes a dish 10, in which a food item 12 can be alternately hidden (See FIG. 1) or visible (See FIG. 2.) The preferred means for doing this is elaborated below.

Figure 3:
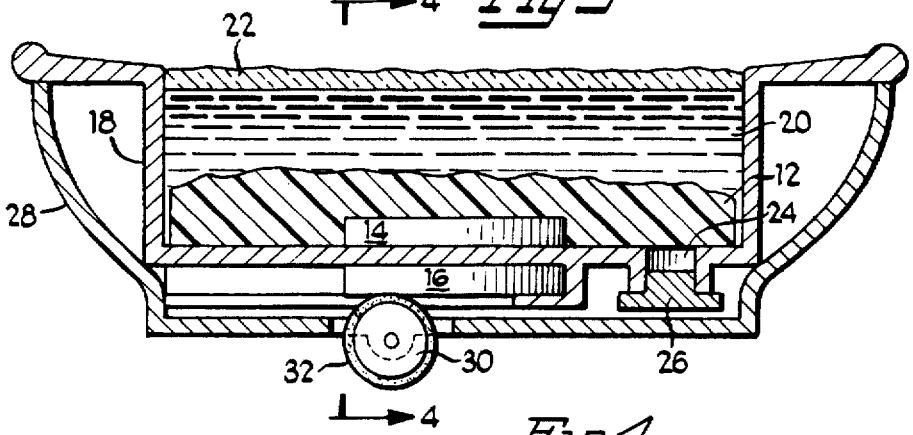
FIG. 3 is a cross-sectional side view of the entire apparatus with the food item hidden.

FIG. 3 shows the invention with the food hidden. The food item 12 is within vessel 18. In this model, food item 12 has substantially the same circumference as the vessel 18, which has the advantage of keeping it centered in vessel 18. This is preferred but not required: however, either some space must exist between vessel 18 and food item 12, or food item 12 must have openings allowing liquid to flow through it, as a complete seal will prevent the movement of food item 12 in vessel 18. Also, it is preferred but not required that vessel 18 be sealed so that opaque liquid 20 cannot escape. Food item 12 has a magnetic attractor 14 in its underside. Second magnetic attractor 16 is located in the underside of vessel 18. The preferred embodiment uses permanent ceramic magnets for both magnetic attractor 14 and second magnetic attractor 16, but any desired magnetic materials may be used, or one may be a ferromagnetic material and the other a magnet, or an electromagnetic attractor may be used. When magnetic attractor 14 and second magnetic attractor 16 are aligned, as in FIG. 3 and FIG. 4, food item 12, which is normally buoyant in opaque liquid 20 contained in vessel 18, is pulled under the surface of liquid 20 and cannot be seen. If an electromagnetic attractor is used, any desired means of activating and varying the strength of the electromagnetic attractor may be used, such as a rheostat or electronic control: such variable electromagnetic attractors are well known to persons of ordinary skill in the art. (See FIG. 9.) The preferred embodiment uses a completely opaque white liquid, but any liquid which will obscure food item 12 will serve.

To operate the invention, the user moves utensil 10 a short distance on any surface. Friction enhancing material 32 on wheel 30 engages second magnetic attractor 16, causing it to move through a channel on the underside of vessel 18. When second magnetic attractor 16 moves a sufficient distance, it can no longer exert sufficient force on magnetic attractor 14 to overcome food unit 12's buoyancy, and food unit 12 returns to the surface, giving the appearance of "food" ready to be "eaten." Moving utensil 10 a short distance in the other direction returns the magnetic attractors to the proper proximity, resubmerging food unit 12 and giving the appearance of "food" having been "eaten." Any desired means of altering the proximity of magnetic attractor 14 and second magnetic attractor 16 may be used or an electromagnetic switch used to control an electromagnetic attractor if such is used.

Figure 4:
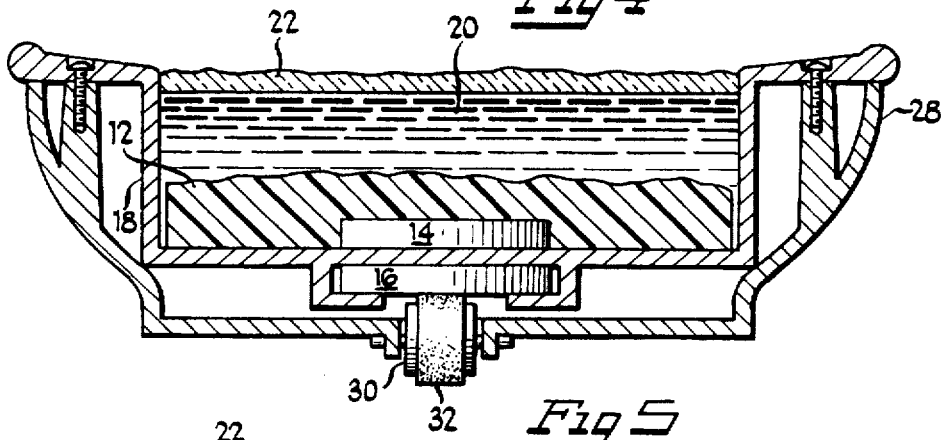
FIG. 4 is a cross-sectional front view of the entire apparatus with the food item visible.

FIG. 4 shows an alternate view of the invention with wheel 30 and the channel in the underside of vessel 18 facing the viewer.

Figure 5:
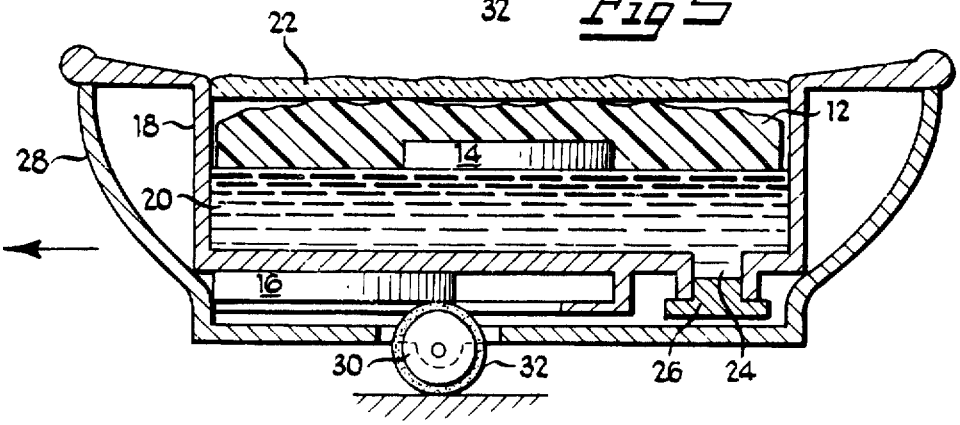
FIG. 5 is a cross-sectional side view of the entire apparatus with the food item visible.

FIG. 5 shows the invention with food unit 12 visible at the top of liquid 20. Second magnetic attractor 16 has moved beyond the necessary distance from magnetic attractor 14, and the buoyancy of food item 12 has raised it to the surface of liquid 20 where it can be seen through transparent cover 22. It should be noted that the user is completely isolated from vessel 18 by outer bowl 28, but outer bowl 28 may be removed so that vessel 18 can be filled by removing plug 26 from port 24 and adding fluid. Alternatively, vessel 18 could be permanently sealed after filling at the time of manufacture.

Figure 6A:
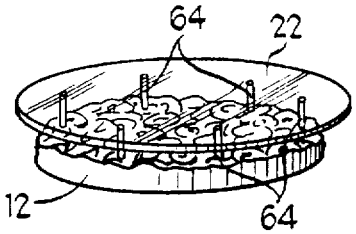
FIG. 6 is a cross-sectional side view of an alternate embodiment using a mechanical linkage with the food unit hidden.
Figure 6:
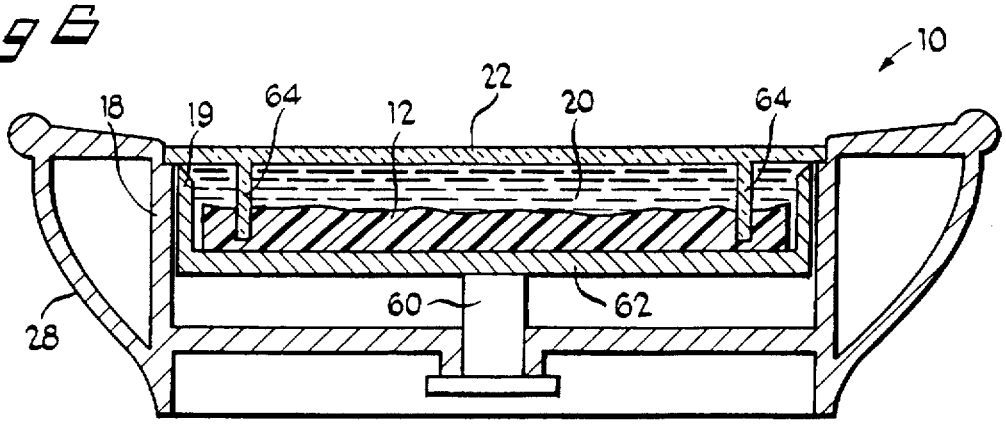

FIG. 6 shows an alternate embodiment using a more traditional mechanical linkage in place of a non-contact (magnetic attraction) system as described above. Sealed vessel 18 now contains a moveable portion 19 having a bottom portion 62. Post 60 is connected to moveable portion 19. When post 60 moves up, moveable portion 19 moves up until bottom portion 62 is in contact with food item 12. Moveable portion 19 seals in fluid 20, so when moveable portion 19 is raised, fluid 20 flows around transparent supports 64 (See FIG. 6*a*) and obscures food item 12. Post 60 may be raised by any desired means, such as a lever protruding from the apparatus, a gear assembly, a cam, or any other means. An air or fluid pressure system could also be used to raise moveable portion 19. It is preferred but not required that bottom portion 62 come in contact with food item 12, as this greatly reduces the amount of fluid 20 required to achieve the desired level, obscuring food item 12.

FIG. 6*a* shows the details of the connection between transparent cover 22 and food item 12. Transparent cover 22 is connected to food item 12 by one or more transparent supports 64, which enables liquid 20 (not shown, see FIGS. 6 and 7) to flow freely over the entire surface of food item 12 during the hiding and revealing processes.

FIG. 7 shows the above described alternate embodiment with the food item revealed. Post 60 has been lowered by the desired means, and moveable portion 19 has reached its lowest point in the range of its movement. Fluid 20, contained by moveable portion 19, has been reduced in level and has flowed down from around food item 12, which is now visible through transparent cover 22. The proper level of fluid 20 and the proper selection of possible movement for moveable portion 19 will produce the illusion that food item 12 is suspended in fluid 20. The cycle may then be repeated.

FIG. 8 shows an alternate embodiment using a more traditional hydraulic system in place of a non-contact (magnetic attraction) system as described above. In this embodiment, it is required that food item 12 form a complete seal in sealed vessel 18. It may or may not be fixed in place, but this is preferred. As shown, most of fluid 20 is in the upper portion of sealed vessel 18, obscuring food item 12. Pump 80 is used to move fluid 20 through outlet 84, through pump 80, and then through inlet 82. When a sufficient quantity of fluid 20 has moved through the system, food unit 12 will be obscured and will not be visible through transparent cover 22. Although pump 80 is shown as a bellows pump, any type of fluid movement system may be used. The invention is wholly independent of the fluid movement means. Likewise, a valve may be used to control the return of fluid to the lower area of sealed vessel 18, or a second pump may be used, or pump 80 may be reversible.

FIG. 9 shows an alternate embodiment using an electromagnet as the second magnetic attractor. In its simplest embodiment, an electromagnet is a coil of wire with an applied direct current, which is herein shown. Coil 92 is placed under vessel 18. A direct current is applied to wire 94, circulates through coil 92, and completes its circuit through output wire 96. Any desired power source, such as a battery, may be used (Not Shown). The flow of current in coil 92 generates a magnetic field, attracting magnetic attractor 14, thereby submerging food item 12 beneath liquid 20. When the current is removed, coil 92 stops generating a field, which allows food item 12 to again float to the surface of liquid 20. Electromagnets may be designed in many different ways: any desired configuration may be used so long as the field strength resulting is sufficient to lower food unit 12. It is preferred, but not required, that in such an embodiment magnetic attractor 14 is a ferromagnetic material which itself does not have an appreciable magnetic field. This avoids the potential for misaligning the polarities of the magnetic attractor 14 and the coil 92. However, with careful selection of relative magnetic strengths and polarities, the use of a magnet for magnetic attractor 14 can actually reduce the amount of current required in coil 92. Selection of materials and alignment of polarities is controlled by engineering and cost factors: the invention will function in a wide variety of configurations.

While the description above details the preferred and best mode of practicing the invention, many other configurations and variations are possible. For example:

1) The illusory item may have openings allowing liquid to flow through it, or the fluid flow may occur around the edges of the illusory item.

2) The invention need not be practiced as a feeding toy, but could be used for any desired illusory purpose, for instance as an indicator or "payoff" in a game of chance or skill.

3) The change in magnetic attraction and consequent change in the visibility of the item could be automatically controlled periodically, randomly, or in response to desired conditions.

Accordingly, the scope of the invention should be determined not by the embodiment(s) illustrated, but by the claims below and their equivalents.

The above discussion shows that the present invention makes possible a illusory liquid apparatus which provides the illusion of items appearing and disappearing. Additionally, the present invention makes possible a simpler and more illusory apparatus by removing the need for mechanical linkages and complex moving parts. Further, the invention provides a liquid illusory apparatus that is independent of special accessories or prepared objects. Finally, the present invention makes possible a safer illusory apparatus, by allowing the construction of a magnetically controlled illusory toy in which all parts and fluids are fixed in place and sealed away from the user. Therefore, the protection of a patent is requested for the invention as set forth in the claims below.

What is claimed is:

1. An illusory liquid apparatus comprising:

A) a vessel;

B) a liquid, contained in the vessel;

C) an illusory item, suspended in the liquid;

C) a first magnetic attractor attached to the illusory item;

D) a second magnetic attractor in variable proximity to the first magnetic attractor, and;

E) means for altering the proximities of the first magnetic attractor and the second magnetic attractor.

2. An illusory liquid apparatus as in claim 1, wherein the second magnetic attractor is an electromagnet, having a variable magnetic strength, in operable proximity to the vessel, and further comprising:

F) means for altering the variable magnetic strength of the electromagnetic attractor.

3. An illusory liquid apparatus as in claim 2, wherein the first magnetic attractor comprises a material which can be attracted by a magnetic field.

4. An illusory liquid apparatus as in claim 2, wherein the first magnetic attractor is a permanent ceramic magnet.

5. An illusory liquid apparatus as in claim 1, wherein the first magnetic attractor and the second magnetic attractor are permanent ceramic magnets.

6. An illusory liquid apparatus as in claim 1, wherein the first magnetic attractor comprises a material which can be attracted by a magnetic field.

7. An illusory liquid apparatus as in claim 1, wherein the second magnetic attractor comprises a material which can be attracted by a magnetic field.

8. An illusory liquid apparatus, comprising:

A) a vessel;

B) a liquid, contained in the vessel;

C) an illusory item, fixed in place within the vessel, forming a seal between a first area of the vessel, and a second area of the vessel;

D) an inlet to the first area of the vessel;

E) an outlet to the second area of the vessel, and;

F) means for moving the liquid from the first area of the vessel to the second area of the vessel, and back to the first area of the vessel, alternatively revealing and obscuring the illusory item.

* * * * *